US012117001B2

(12) United States Patent
Crum et al.

(10) Patent No.: US 12,117,001 B2
(45) **Date of Patent: *Oct. 15, 2024**

(54) SCREW COMPRESSOR WITH OIL INJECTION AT MULTIPLE VOLUME RATIOS

(71) Applicant: Ingersoll-Rand Industrial U.S., Inc., Davidson, NC (US)

(72) Inventors: Daniel R. Crum, Huntersville, NC (US); Ryan Patrick Coleman, Huntersville, NC (US); Nobin Cherian, Karnataka (IN)

(73) Assignee: Ingersoll-Rand Industrial U.S., Inc., Davidson, NC (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/218,428

(22) Filed: Jul. 5, 2023

(65) Prior Publication Data

US 2023/0349384 A1 Nov. 2, 2023

Related U.S. Application Data

(63) Continuation of application No. 17/474,642, filed on Sep. 14, 2021, now Pat. No. 11,732,715, which is a (Continued)

(51) Int. Cl.

| | |
|---|---|
| ***F04C 18/16*** | (2006.01) |
| ***F04C 29/00*** | (2006.01) |
| ***F04C 29/02*** | (2006.01) |

(52) U.S. Cl.

CPC ..... *F04C 18/16* (2013.01); *F04C 29/0007* (2013.01); *F04C 29/02* (2013.01); *F04C 2240/20* (2013.01); *F04C 2240/30* (2013.01)

(58) Field of Classification Search

CPC ..... F04C 18/16; F04C 29/0007; F04C 29/02

See application file for complete search history.

(56) References Cited

U.S. PATENT DOCUMENTS

| | | | |
|---|---|---|---|
| 3,073,514 | A | 1/1963 | Wilfred et al. |
| 3,129,877 | A | 4/1964 | Robert et al. |

(Continued)

FOREIGN PATENT DOCUMENTS

| | | | |
|---|---|---|---|
| CN | 105952639 | A | 9/2016 |
| DE | 2720214 | A1 | 12/1977 |

(Continued)

OTHER PUBLICATIONS

Examination Report in European Application No. 18198614.2, dated Nov. 28, 2019.

(Continued)

*Primary Examiner* — Mary Davis

(74) *Attorney, Agent, or Firm* — Kevin West; Advent, LLP

(57) ABSTRACT

The present disclosure is directed to a screw compressor system having a compressor housing with a pair of screw rotors rotatably supported within a compression chamber. Lubricant is injected into a compression chamber at a first volume ratio and at a second volume ratio greater than the first volume ratio to increase the sealing and lubrication between the screw rotors and rotor bores in the compressor housing as well as to increase heat transfer from a compressed working fluid in the compression chamber.

20 Claims, 4 Drawing Sheets

Related U.S. Application Data continuation of application No. 15/724,787, filed on Oct. 4, 2017, now Pat. No. 11,118,585.

(56) References Cited

U.S. PATENT DOCUMENTS

| | | | | |
|---|---|---|---|---|
| 3,178,104 | A | 4/1965 | Williams et al. | |
| 3,241,744 | A | 3/1966 | Benedictus et al. | |
| 3,795,117 | A | 3/1974 | Moody, Jr. et al. | |
| 3,820,923 | A | 6/1974 | Zweifel et al. | |
| 4,080,119 | A | 3/1978 | Eriksson | |
| RE30,499 | E | 2/1981 | Moody, Jr. et al. | |
| 4,497,185 | A | 2/1985 | Shaw | |
| 5,037,282 | A | 8/1991 | Englund | |
| 5,509,273 | A | 4/1996 | Lakowske et al. | |
| 5,653,585 | A | 8/1997 | Fresco | |
| 7,647,790 | B2 | 1/2010 | Ignatiev et al. | |
| 7,993,110 | B1 | 8/2011 | Hill | |
| 11,118,585 | B2 | 9/2021 | Crum et al. | |
| 11,732,715 | B2 * | 8/2023 | Crum | F04C 18/16 418/83 |
| 2011/0014077 | A1 | 1/2011 | Martens | |
| 2012/0207634 | A1 | 8/2012 | Heger et al. | |
| 2013/0058822 | A1 | 3/2013 | Feller et al. | |

FOREIGN PATENT DOCUMENTS

| | | | |
|---|---|---|---|
| DE | 102010002649 | A1 | 9/2011 |
| DE | 202016006678 | U1 | 1/2017 |
| EP | 0389036 | A1 | 9/1990 |
| JP | S52135407 | A | 11/1977 |
| WO | 9518945 | A1 | 7/1995 |
| WO | 2009121151 | A1 | 10/2009 |
| WO | 2018023177 | A1 | 2/2018 |

OTHER PUBLICATIONS

Extended European Search Report in European Application No. 18198614.2, dated Feb. 22, 2019.

Office Action from Chinese Application No. 2022106866040, dated Dec. 20, 2023.

* cited by examiner

SCREW COMPRESSOR WITH OIL INJECTION AT MULTIPLE VOLUME RATIOS

TECHNICAL FIELD

The present application generally relates to industrial air compressor systems and more particularly, but not exclusively, to a rotary screw compressor with oil injection at multiple volume ratios within the compression chamber.

BACKGROUND

Industrial compressor systems are configured to produce a pressurized fluid such as compressed air or the like. Contact cooled screw compressors include oil injection to cool and seal portions of the compression chamber. Some existing systems have various shortcomings, drawbacks, and disadvantages relative to certain applications. Accordingly, there remains a need for further contributions in this area of technology.

SUMMARY

One embodiment of the present application is a compressor system with oil injection at multiple volume ratios. Other embodiments include apparatuses, systems, devices, hardware, methods, and combinations for methods of cooling and sealing the compression chamber at various locations along the flowpath. Further embodiments, forms, features, aspects, benefits, and advantages of the present application shall become apparent from the description and figures provided herewith.

DETAILED DESCRIPTION OF THE ILLUSTRATIVE EMBODIMENTS

Figure 1:
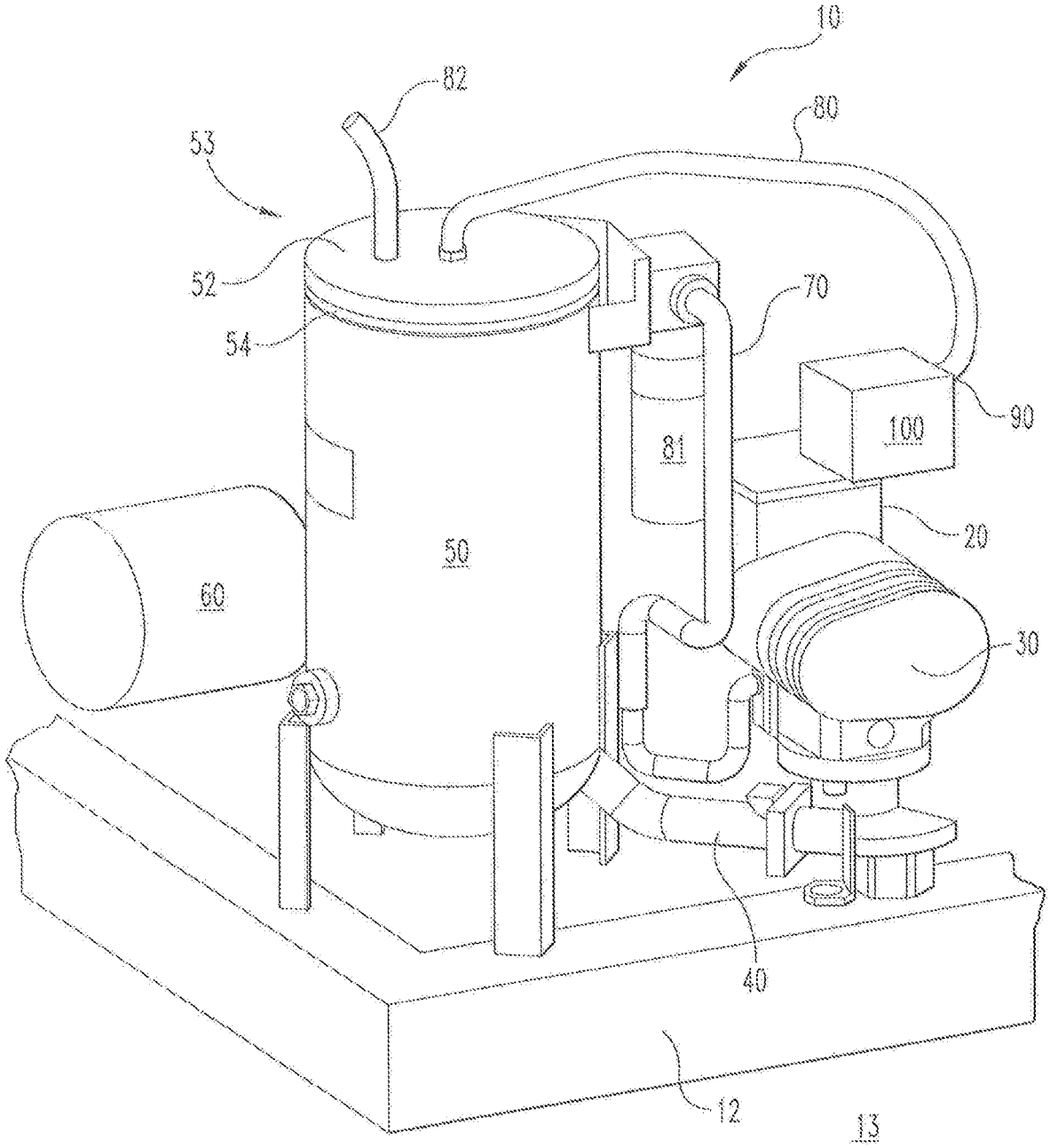
FIG. 1 is a perspective view of a compressor system according to one embodiment of the present disclosure.

For the purposes of promoting an understanding of the principles of the invention, reference will now be made to the embodiments illustrated in the drawings and specific language will be used to describe the same. It will nevertheless be understood that no limitation of the scope of the invention is thereby intended. Any alterations and further modifications in the described embodiments, and any further applications of the principles of the invention as described herein are contemplated as would normally occur to one skilled in the art to which the invention relates.

Industrial compressor systems are configured to provide large quantities of compressed fluids at a desired temperature, pressure and mass flow rate. Some compressor systems include fluid-to-fluid heat exchangers to control the temperature of a compressed fluid at various stages within the system. The term "fluid" should be understood to include any gas or liquid medium used in the compressor system as disclosed herein. In one aspect the fluid can include mixtures of air and oil and can be separated into separate constituents in a separating tank. It should be understood that when the term "air" is used in the specification or claims that other working fluids are included under a broad definition of compressible fluids. Also, when the terms "oil" or "lubricant" are used in the specification or claims, it should be understood that any lubrication fluid whether carbon based or synthetic in nature is contemplated herein.

In a screw compressor, the compression chamber can be defined at any location by a volume ratio. The volume ratio is the volume of a compression pocket at a defined location relative the volume in the compression pocket at the start of compression. The maximum volume ratio occurs in the compression pocket just prior to discharge from the compression chamber. For example, at a location in the compression chamber where the inlet volume has just been closed off from an inlet port by meshed male and female screw rotors, the volume ratio is 1.0. A compression pocket is formed when the lobes of helical male and female rotors mesh and close off the pocket from both the inlet port at one end and a discharge port at the other end of the compression chamber. The volume ratio within the compression chamber will increase as the volume of the compression pocket is reduced. The volume ratio will continue to increase until the compressor pocket is opened to a discharge region downstream of the compression chamber. The maximum volume ratio occurs just prior to the compression pocket opening into a discharge region downstream of the compression chamber. By way of example, if the screw compressor is designed to compress the compressible flow into a volume that is five times smaller than the inlet volume, then the maximum volume ratio is 5.0.

The present disclosure is directed to injecting lubricant at multiple positions or volume ratios within the compression chamber. Lubricant can be injected early in the compression process at a low volume ratio to lubricate the male screw rotor surfaces, the female screw rotor surfaces and the compressor housing surfaces adjacent the rotor surfaces. The lubricant also provides sealing for clearance regions including the mesh line of the helical tip surfaces between the male and female rotors as well as between the rotor tips and the rotor bores of the compressor housing. Lubricant can be injected later in the compression process at a higher volume ratio to lower the temperature of the compressible working fluid after at least some compression has occurred in the compression chamber. While the exemplary embodiment discloses lubricant injection at two distinct volume ratios, it should be understood that lubricant injection may be utilized at three or more different or distinct volume ratios in certain compressor systems to further cool the compressed working fluid. Lubricant injection at higher volume ratios increases heat transfer and thus reduces the temperature of the working fluid due to the heat of compression thereby improving operating efficiency of the compressor.

Referring now to FIG. 1, an exemplary compressor system 10 is shown therein. The compressor system 10 includes a primary motive source 20 such as an electric motor, an internal combustion engine or a fluid-driven turbine and the like. The compressor system 10 can include a compressor 30 that may include multi-stage compression. The compressor 30 can include screw rotors operable to compress a working fluid such as air and oil vapor or the like.

A structural base 12 is configured to support at least portions of the compressor system 10 on a support surface 13 such as a floor or ground. Portions of the compressed working fluid discharged from the compressor 30 can be transported through one or more conduits 40 to a sump or separator tank 50 for separating fluid constituents such as air and oil or the like. One or more coolers 60 can be operably coupled with the system 10 for cooling working fluids to a desired temperature in some embodiments. The one or more coolers 60 can cool working fluids such as compressed air or oil to a desired temperature. The compressor system 10 can also include a controller 100 operable for controlling the primary motive power source 20 and various valving and fluid control mechanisms (not shown) between the compressor 30 and intercoolers 60 such as a blow down valve 90.

The separator tank 50 can include a lid 52 positioned proximate a top portion 53 thereof. A seal 54 can be positioned between the lid 52 and separator tank 50 so as to provide a fluid-tight connection between the lid 52 and the separator tank 50. Various mechanical means such as threaded fasteners (not shown) or the like can be utilized to secure the lid 52 to the separator tank 50. A blow down conduit 80 can extend from the separator tank 50 to the blow down valve 90. The blow down valve 90 is operable for reducing pressure in the separator tank 50 when the compressor 30 is unloaded and not supplying compressed air to an end load. An air supply conduit 82 can be operably coupled to the separator tank 50 so as to deliver compressed air to a separate holding tank (not shown) or to an end load for industrial uses as would be known to those skilled in the art. An oil supply conduit 70 can extend from the separator tank 50 to the compressor 30 to supply oil that has been separated from the working fluid in the separator tank 50 to the compressor 30. One or more filters 81 can be used in certain embodiments to filter particles from the oil and/or separate contaminates such as water or the like from working fluids in the compressor system 10.

Figure 2:
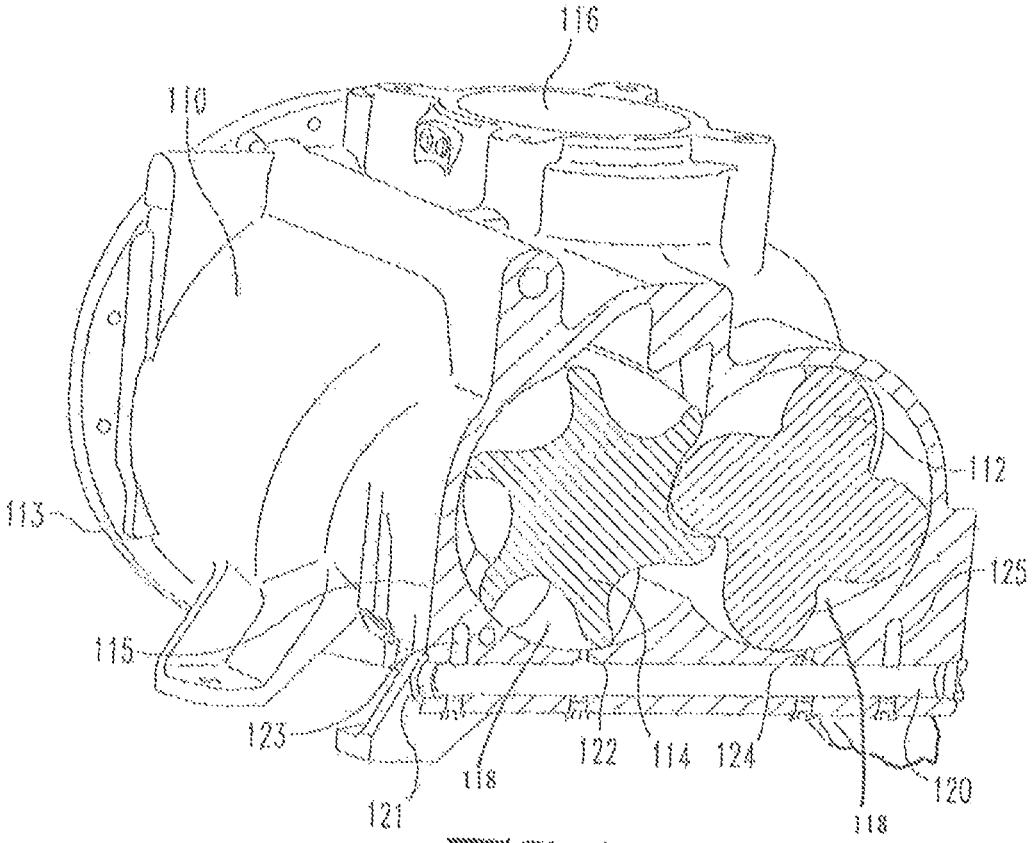
FIG. 2 is a perspective view of a compressor housing according to an embodiment of the present disclosure.

Referring now to FIG. 2, a perspective cross-sectional view of an exemplary compressor housing 110 is illustrated therein. The compressor housing 110 is configured to rotatably support the male screw rotor 112 and a meshed female screw rotor 114. An inlet 116 is formed in a wall of the compressor housing 110 to permit a compressible fluid to be drawn into a compression chamber 118 formed between the compressor housing 110 and the male and female screw rotors 112, 114, respectively. The compressor housing 110 extends between a first end 113 proximate the inlet port 116 and a second end 115 proximate a discharge port 140 (see FIGS. 3 and 4). The compressor housing 110 can include a lubricant gallery 120 extending from a main inlet port 121 that is connected to a lubricant supply tank (not shown). In one form the lubricant gallery 120 may extend laterally across the compressor housing 110 past the male and female screw rotors 112, 114. In other forms, the compressor housing 110 may include additional lubricant galleries or passages separate from or in fluid communication with the lubricant gallery 120 and/or directly with the main lubricant supply tank. A plurality of lubricant injectors that include lubricant injection ports are in fluid communication with the lubricant gallery 120 and can be utilized to direct lubricant into the compression chamber 118. In the exemplary embodiment, a first lubricant injection port 122 and a second lubricant injection port 124 extends from the lubricant gallery 120, however, in the alternate embodiments, more than two lubricant injection ports can be placed in fluid communication with the lubricant gallery 120. The injection ports 122, 124 define a passageway from the lubricant gallery 120 into the compression chamber 118. In other embodiments additional lubricant galleries may be positioned in various locations within the walls of the compressor housing 110.

The first lubricant injection port 122 is positioned so as to inject a flow of lubricant into the compression chamber 118 and impinge on the female rotor 114 at a relatively high volume ratio proximate the second end 115 of the compressor housing 110. The second lubricant injection port 124 is positioned so as to inject a flow of lubricant into the same compression chamber 118 and impinge on the male rotor 112 at a relatively high volume ratio proximate the second end 115 of the compressor housing 110. The first and second lubricant injection ports 122, 124 can inject lubricant into the compression chamber 118 at approximately the same volume ratio in some embodiments. In some embodiments, the injection ports 122, 124 as well as other injection ports, can be sized to provide approximately the same mass flow rate of lubricant into the compression chamber 118. In alternate embodiments, the injection ports 122, 124 as well as other injection ports can be formed with different flow areas and thereby inject lubricant at different mass flow rates.

A first vertical passageway 123 can extend from the lubricant gallery 120 in a wall of the compressor housing 110 proximate the female rotor 114 and a second vertical passageway 125 can extend from the lubricant gallery 120 in a wall of the compressor housing 110 proximate the male rotor 114. While the term "vertical" is used to describe the passageways 123, 125 it should be understood that passageways may extend at any direction from the lubricant gallery 120 and not necessarily in an absolute vertical direction. The first and second vertical passageways 123, 125 operate to direct lubricant to other locations within the compressor housing 110.

Figure 3:
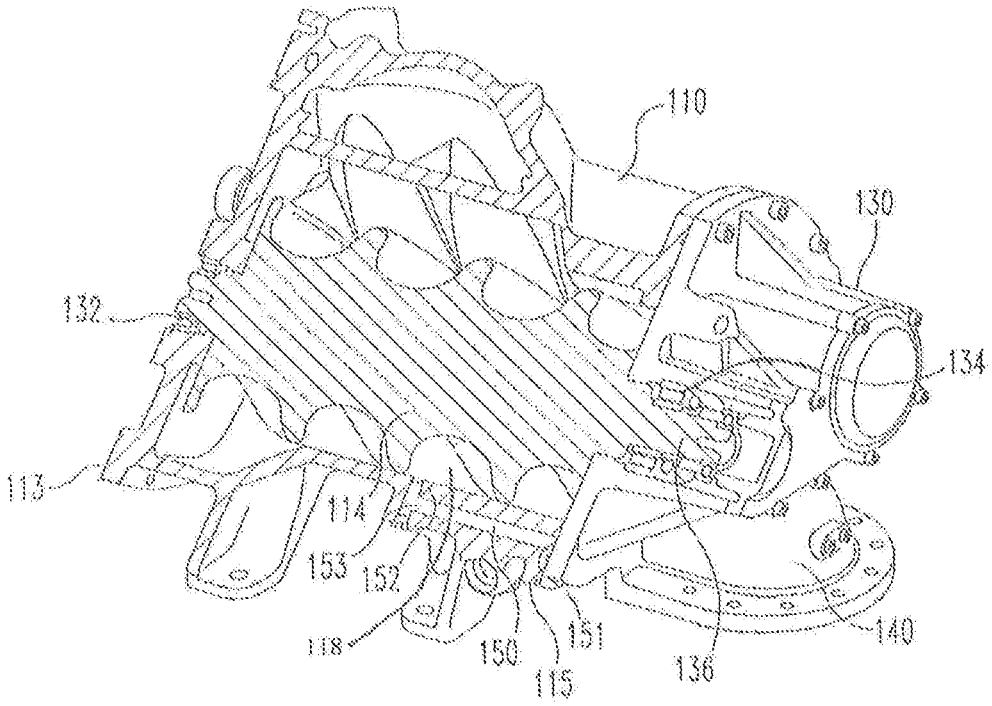
FIG. 3 is a perspective view of a portion of the compressor housing of FIG. 2 partially cut-away to show a lubricant injection location relative to a female rotor.
Figure 4:
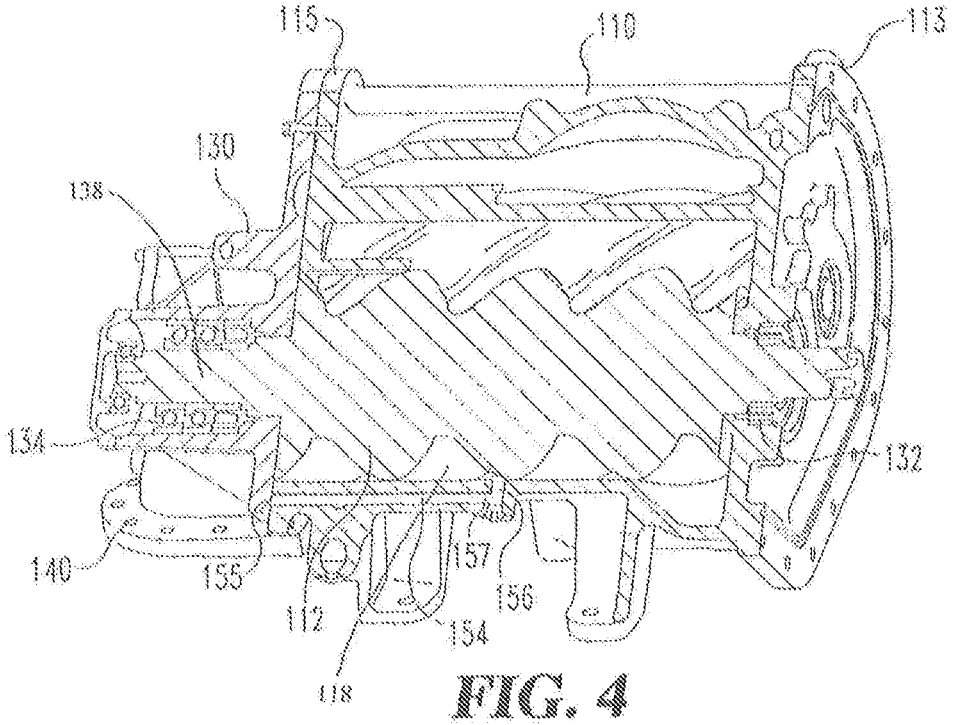
FIG. 4 is a perspective view of a portion of the compressor housing of FIG. 2 partially cut-away to show a lubricant injection location relative to a male rotor.

Referring now to FIGS. 3 and 4, the compressor housing 110 is partially cut-away to show cross-sectional portions of the female rotor 114 and the male rotor 112, respectively. The compressor housing 110 can include a bearing housing 130 connected to the second end 115 thereof. First and second bearing assemblies 132, 134 are located at either end of the compressor housing 110 to rotatably support a female rotor shaft 136 and a male rotor shaft 138, respectively.

A first axial lubricant gallery 150 (FIG. 3) is in fluid communication with the first vertical passageway 123 (see FIG. 2) and extends along a longitudinal length of the compressor housing 110 between a first end 151 and a second end 153. The first end 151 of the first axial lubricant gallery 150 is located proximate the discharge end of the compression chamber 118. The second end 153 of the first axial lubricant gallery 150 is located at an upstream location of the compression chamber 118 which is at a lower volume ratio than the first end 151. A third lubricant injection port 152 is in fluid communication with the first axial lubricant gallery 150. The third lubricant injection port 152 extends to the compression chamber 118 from the second end 153 of the first axial lubricant gallery 150. The third lubricant injection port 152 injects lubricant into the compression chamber 118 such that a portion of the lubricant flow impinges on the female screw rotor 114 at a lower volume ratio than either of the first or second lubricant injection ports 122, 124.

A second axial lubricant gallery 154 (FIG. 4) is in fluid communication with the second vertical passageway 125 (see FIG. 2) and extends along a longitudinal length of the compressor housing 110 between a first end 155 and a second end 157. The first end 155 of the second axial lubricant gallery 154 is located proximate the discharge end of the compression chamber 118. The second end 157 of the second axial lubricant gallery 154 is located at an upstream location of the compression chamber 118 which is at a lower volume ratio than the first end 155. A fourth lubricant injection port 156 is in fluid communication with the second axial lubricant gallery 154. The fourth lubricant injection port 156 extends to the compression chamber 118 from the second end 157 of the second axial lubricant gallery 154.

The fourth lubricant injection port 156 injects lubricant into the compression chamber 118 such that a portion of the lubricant flow impinges on the male screw rotor 112 at a lower volume ratio than either of the first or second lubricant injection ports 122, 124. In this manner lubricant can be injected into the compression chamber 118 at a plurality of different volume ratios to provide desired lubricating, sealing and cooling means.

Figure 5:
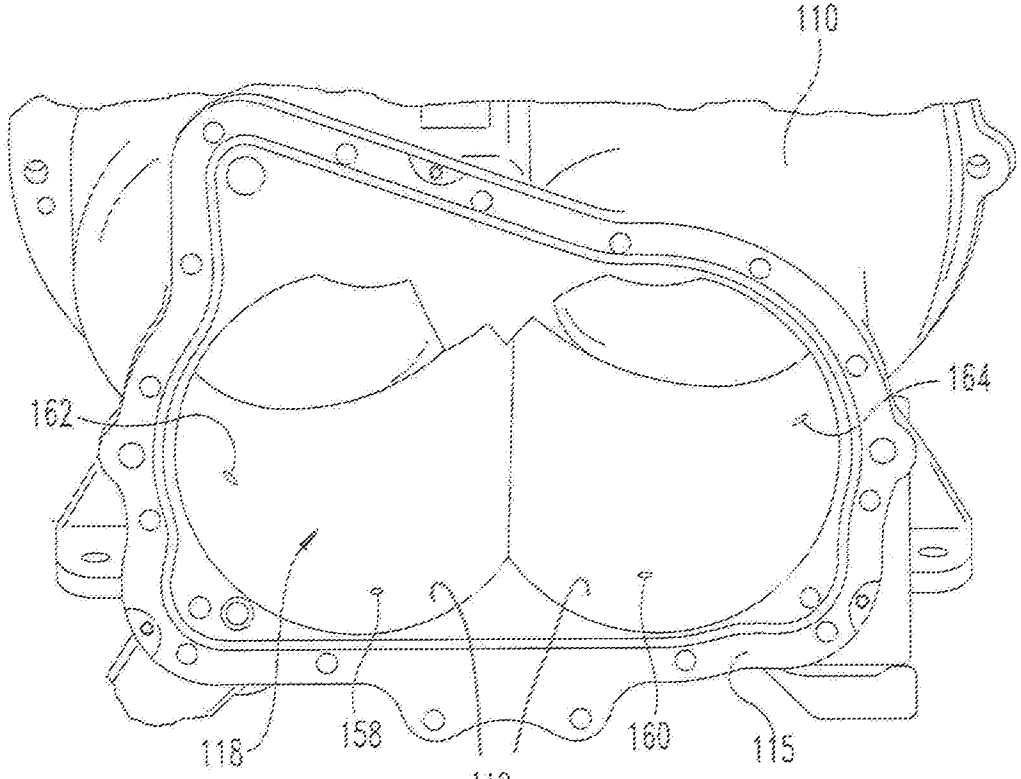
FIG. 5 is a perspective view of a portion of the compressor housing of FIG. 2 with the rotors removed to show exemplary locations of discharge orifices for lubricant injection ports at different volume ratios.

Referring now to FIG. 5, a perspective end view of the of the compressor housing 110 is shown with the male and female rotors 112, 114 removed for clarity. An inner bore 119 of the compression chamber 118 shows locations of four discharge orifices 158, 160, 162 and 164 that extend from corresponding injection ports 122, 124, 152 and 156 (See FIGS. 2-4) through the inner bore 119 of the compression chamber 118. The relative positions of the discharge orifices 158, 160, 162 and 164 within the inner bore 119 are exemplary in nature to show that lubricant injection may be located at different volume ratios. It should be noted that the location of each discharge orifice 158, 160, 162 and 164 may vary in other embodiments.

In one aspect, the present disclosure includes a compressor comprising: a compressor housing; a compression chamber extending between first and second ends of the housing; an inlet port upstream of the compression chamber; a discharge port downstream of the compression chamber; male and female screw rotors rotatably meshed together within the compression chamber, the screw rotors operable for compressing a working fluid; a compression pocket defined by a region in the compression chamber that is sealed from the inlet port and the discharge port; a volume ratio defined within the compression pocket, the volume ratio varying between 1.0 at an entrance region proximate the first end of the compression chamber and a design maximum volume ratio at an exit region proximate the second end of the compression chamber; a first lubricant injector configured to inject lubricant into the compression chamber at a first volume ratio; and a second lubricant injector configured to inject lubricant into the compression chamber at a second volume ratio, wherein the second volume ratio is larger than the first volume ratio.

In refining aspects, the present disclosure includes a compressor system further including a third lubricant injector configured to inject lubricant into the compression chamber at a third volume ratio different from the first and second volume ratios; first and second injection ports extending through the housing at each of the first and second volume ratios; wherein the first injection port is positioned adjacent one of the male or female screw rotors and the second injection port is positioned adjacent the other of the male or female screw rotors; wherein the injected lubricant impinges onto one or both of the male and female screw rotors and mixes with the compressed working fluid in the compression chamber; wherein the housing includes a main lubricant gallery extending across a width of the housing; wherein the main lubricant gallery is positioned proximate the second end of the housing adjacent the discharge port; a main lubricant inlet port connected to the main lubricant gallery, the main lubricant inlet port in fluid communication with a source of lubricant; first and second axial lubricant galleries in fluid communication with the main lubricant gallery; one or more lubricant injector ports extending from each of the first and second axial lubricant passages, respectively; and a connecting passageway extending between each of the first and second axial lubricant galleries and the main lubricant gallery.

In another aspect, the present disclosure includes a compressor comprising: a compressor housing; a compression chamber extending between first and second ends of the housing; an inlet port upstream of the compression chamber; a discharge port downstream of the compression chamber; male and female screw rotors rotatably meshed together within the compression chamber, the screw rotors operable for compressing a working fluid; a compression pocket defined by a region in the compression chamber that is sealed from the inlet port and the discharge port; a first lubricant injector port configured to inject lubricant into the compression chamber at a first volume ratio; and a second lubricant injector port configured to inject lubricant into the compression chamber at a second volume ratio, wherein the second volume ratio is larger than the first volume ratio.

In refining aspects, the present disclosure includes a screw compressor further comprising: a third lubricant injector port configured to inject lubricant into the compression chamber at the first volume ratio; and a fourth lubricant injector port configured to inject lubricant into the compression chamber at the second volume ratio; wherein lubricant from the first and second lubricant injector ports impinge on the male screw rotor and the female screw rotor, respectively and mixes with the compressed working fluid in the compression pocket; wherein lubricant from the third and fourth lubricant injector ports impinge on the other of the male screw rotor and female screw rotor, respectively and mixes with the compressed working fluid in the compression pocket; further comprising a main lubricant gallery extending across one end of the compressor housing; wherein the first and third injector ports extend directly from the main lubricant gallery; further comprising first and second axial lubricant galleries extending from the main lubricant gallery; and wherein the second and fourth injector ports extend from a distal end of the first and second axial lubricant galleries, respectively.

In another aspect, the present disclosure includes a method comprising a working fluid in a compression chamber with a meshed pair of male and female screw rotors; injecting lubricant into the compression chamber at a first volume ratio; and injecting lubricant into the compression chamber at a second volume ratio, the second volume ratio being greater than the first volume ratio.

In refining aspects, the present disclosure includes a method further comprising impinging the lubricant onto the male screw rotor and onto the female screw rotor at each of the first and second volume ratios in the compression chamber, and mixing the lubricant with the working fluid at each of the first and second volume ratios in the compression chamber.

While the invention has been illustrated and described in detail in the drawings and foregoing description, the same is to be considered as illustrative and not restrictive in character, it being understood that only the preferred embodiments have been shown and described and that all changes and modifications that come within the spirit of the inventions are desired to be protected. It should be understood that while the use of words such as preferable, preferably, preferred or more preferred utilized in the description above indicate that the feature so described may be more desirable, it nonetheless may not be necessary and embodiments lacking the same may be contemplated as within the scope of the invention, the scope being defined by the claims that follow. In reading the claims, it is intended that when words such as "a," "an," "at least one," or "at least one portion" are used there is no intention to limit the claim to only one item unless specifically stated to the contrary in the claim. When the language "at least a portion" and/or "a portion" is used the item can include a portion and/or the entire item unless specifically stated to the contrary.

Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

What is claimed is:

1. A compressor comprising:

a compressor housing;

a compression chamber defined by an inner bore and first and second ends of the compressor housing, the inner bore extending between the first and second ends of the compressor housing;

a first lubricant injection port defined between the first and second ends and in the inner bore of the compressor housing, the first lubricant injection port configured to inject lubricant into the compression chamber through the inner bore at a first volume ratio;

a second lubricant injection port defined between the first and second ends and in the inner bore of the compressor housing, the second lubricant injection port configured to inject lubricant into the compression chamber through the inner bore at a second volume ratio, wherein the second volume ratio is larger than the first volume ratio; and a main lubricant gallery formed in the compressor housing and a main lubricant inlet connected to the main lubricant gallery, the first and second lubricant injection ports fluidly coupled with the main lubricant gallery through a respective first and second axial galleries extending from the main lubricant gallery, the first and second lubricant injection ports each define a passageway from the respective first and second axial galleries into the compression chamber to direct lubricant from the main lubricant inlet into the compression chamber.

2. The compressor of claim 1, further comprising a third lubricant injection port configured to inject lubricant into the compression chamber at a third volume ratio different from the first and second volume ratios.

3. The compressor of claim 2, wherein the third lubricant injection port is fluidly coupled with the main lubricant gallery through the first or second axial gallery.

4. The compressor of claim 1, further comprising:

male and female screw rotors rotatably meshed together within the compression chamber, the male and female screw rotors operable for compressing a working fluid.

5. The compressor of claim 4, wherein the first lubricant injection port is positioned adjacent one of the male or female screw rotors and the second injection port is positioned adjacent the other of the male or female screw rotors.

6. The compressor of claim 4, wherein the first lubricant injection port or the second lubricant injection port is configured to impinge lubricant onto one or both of the male and female screw rotors and mixes with the compressed working fluid in the compression chamber.

7. The compressor of claim 1, wherein the main lubricant gallery extends across a width of the housing.

8. The compressor of claim 1, wherein the main lubricant gallery is positioned proximate the second end of the housing adjacent to a discharge port.

9. The compressor of claim 1, wherein the first lubricant injection port and the second lubricant injection port are formed with different flow areas and thereby inject lubricant at different mass flow rates.

10. The compressor of claim 1, further comprising a connecting passageway extending between each of the first and second axial galleries and the main lubricant gallery.

11. A screw compressor comprising:

a compressor housing;

a compression chamber defined by an inner bore and first and second ends of the compressor housing, the inner bore extending between the first and second ends of the compressor housing;

male and female screw rotors rotatably meshed together within the compression chamber, the male and female screw rotors operable for compressing a working fluid;

a first lubricant injection port defined between the first and second ends and in the inner bore of the compressor housing, the first lubricant injection port configured to inject lubricant into the compression chamber through the inner bore at a first volume ratio;

a second lubricant injection port defined between the first and second ends and in the inner bore of the compressor housing, the second lubricant injection port configured to inject lubricant into the compression chamber through the inner bore at a second volume ratio, wherein the second volume ratio is larger than the first volume ratio;

a main lubricant gallery formed in the compressor housing, the main lubricant gallery elongated in a longitudinal direction that is transverse to the male and female rotors; and first and second axial lubricant galleries formed in the compressor housing and extending from the main lubricant gallery to the first lubricant injection port and to the second lubricant injection port, respectively.

12. The screw compressor of claim 11, wherein the first lubricant injection port and the second lubricant injection port are formed with different flow areas and thereby inject lubricant at different mass flow rates.

13. The screw compressor of claim 11, further comprising:

a third lubricant injection port configured to inject lubricant into the compression chamber at the first volume ratio; and a fourth lubricant injection port configured to inject lubricant into the compression chamber at the second volume ratio.

14. The screw compressor of claim 13, wherein the third lubricant injection port is fluidly coupled with the main lubricant gallery through the first or second axial lubricant gallery.

15. The screw compressor of claim 13, wherein lubricant from the third and fourth lubricant injection ports impinge on the other of the male screw rotor and female screw rotor, respectively and mixes with the compressed working fluid in the compression chamber.

16. The screw compressor of claim 13, wherein the main lubricant gallery extends across one end of the compressor housing.

17. The screw compressor of claim 13, wherein the second and fourth lubricant injection ports extend from a distal end of the first and second axial lubricant galleries, respectively.

18. The screw compressor of claim 11, wherein lubricant from the first and second lubricant injection ports impinge on the male screw rotor and the female screw rotor, respectively and mixes with the compressed working fluid in the compression chamber.

19. A method of operating a compressor comprising:

compressing a working fluid in a compression chamber, the compression chamber defined by an inner bore and two opposing ends of a compressor housing;

injecting lubricant through a first lubricant injection port defined between the two opposing ends and in the inner bore of the compressor housing, the lubricant injected through the first lubricant injection port into the compression chamber at a first volume ratio;

injecting lubricant through a second lubricant injection port defined between the two opposing ends and in the inner bore of the compressor housing, the lubricant injected through the second lubricant injection port into the compression chamber at a second volume ratio, the second volume ratio being greater than the first volume ratio; and wherein the injecting lubricant into the compression chamber at a first volume ratio and at a second volume ratio includes flowing lubricant into a main lubricant gallery within the compressor housing, and subsequently flowing lubricant from the main lubricant gallery into a first axial lubricant gallery and a second axial lubricant gallery respective to the first volume ratio and the second volume ratio, the first and second axial lubricant galleries also formed within the compressor housing, the first axial lubricant gallery feeding the first lubricant injection port, the second axial lubricant gallery feeding the second lubricant injection port.

20. The method of claim 19, further comprising:

impinging the lubricant onto a male screw rotor and onto a female screw rotor at each of the first and second volume ratios in the compression chamber; and mixing the lubricant with the working fluid at each of the first and second volume ratios in the compression chamber.

* * * * *